US010222728B2

(12) United States Patent
Onishi et al.

(10) Patent No.: US 10,222,728 B2
(45) Date of Patent: Mar. 5, 2019

(54) FIXING DEVICE AND IMAGE FORMING APPARATUS

(71) Applicant: KYOCERA Document Solutions Inc., Osaka (JP)

(72) Inventors: Shota Onishi, Osaka (JP); Masuo Kawamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/830,212

(22) Filed: Dec. 4, 2017

(65) Prior Publication Data

US 2018/0157199 A1 Jun. 7, 2018

(30) Foreign Application Priority Data

Dec. 7, 2016 (JP) ..... 2016-237806

(51) Int. Cl.
*G03G 15/20* (2006.01)
*G03G 15/00* (2006.01)

(52) U.S. Cl.
CPC ..... *G03G 15/20* (2013.01); *G03G 15/2017* (2013.01); *G03G 15/2032* (2013.01); *G03G 15/2064* (2013.01); *G03G 15/2028* (2013.01); *G03G 15/2035* (2013.01); *G03G 15/5029* (2013.01); *G03G 15/6588* (2013.01); *G03G 15/6591* (2013.01); *G03G 15/6594* (2013.01); *G03G 2215/2003* (2013.01)

(58) Field of Classification Search
CPC ..... G03G 15/20; G03G 15/2017; G03G 15/2028; G03G 15/2032; G03G 15/2035; G03G 15/2064; G03G 15/5029; G03G 15/6588; G03G 15/6591; G03G 15/6594; G03G 2215/2003
See application file for complete search history.

(56) References Cited

U.S. PATENT DOCUMENTS 10,114,320 B2 * 10/2018 Takemoto ..... G03G 15/2064
2014/0294415 A1 * 10/2014 Maruta ..... G03G 15/80 399/67
2016/0223971 A1 * 8/2016 Moriya ..... G03G 15/206
2017/0248884 A1 * 8/2017 Watanabe ..... G03G 15/2053

FOREIGN PATENT DOCUMENTS

JP 2014-048597 A 3/2014

* cited by examiner

*Primary Examiner* — Joseph S Wong
(74) *Attorney, Agent, or Firm* — Studebaker & Brackett PC

(57) ABSTRACT

A fixing device includes a heating body, a pressuring body, a lateral plate supporting the heating or pressuring body, a first supporting body supporting the heating or pressuring body, a second supporting body including a roller, a tensile spring between the first and second supporting bodies, an eccentric cam, a rotating shaft, a protrusion, a driving part, and a pressing member. The cam is supported between the first and second supporting bodies swingable in the lateral plate and has a depression gradually inclined from an upstream side to a downstream side in a rotation direction. The protrusion is protruded from the rotating shaft and meets the depression. The pressing member presses the cam opposite the protrusion. The cam rotates and meets the roller to shift the second supporting body and to extend and contract the spring, and changes a nip pressure from a first pressure to a lower second pressure.

10 Claims, 17 Drawing Sheets

FIXING DEVICE AND IMAGE FORMING APPARATUS

INCORPORATION BY REFERENCE

This application is based on and claims the benefit of priority from Japanese Patent application No. 2016-237806 filed on Dec. 7, 2016, the entire contents of which are incorporated herein by reference.

BACKGROUND

The present disclosure relates to a fixing device and an image forming apparatus.

For example, it is known that a fixing device includes a fixing film, a pressuring roller and a pressure releasing means releasing a pressure contact state of the fixing film and the pressuring roller. The pressure releasing means has a driving member, a following member (an eccentric cam) and a buffering member. The driving member is driven and rotated by a driving means. The following member is rotatable with a rotating shaft of the driving member, follows with respect to the driving member with a predetermined play in a rotation direction, and has a cam face releasing the pressure contact state of the fixing film and the pressuring roller. The buffering member controls the predetermined play between the driving member and the following member in the rotation direction. Moreover, the following member has a gap into which the driving member and the buffering member are fitted with predetermined play in the rotation direction.

The above-mentioned fixing device may reduce impulsive sound occurring in accordance with overrunning of the following member, but cannot restrain overrunning of the following member.

SUMMARY

In accordance with the present disclosure, a fixing device includes a heating body, a pressuring body, a lateral plate, a first supporting body, a second supporting body, a tensile spring, an eccentric cam, a rotating shaft, a protrusion, a driving part, and a pressing member. The heating body is rotated and heats a medium on which a toner image is formed. The pressuring body forms a nip with the heating roller, is rotated and pressures the medium passing through the nip. The lateral plate supports one body of the heating body and the pressuring body rotatably. The first supporting body is swingably supported to the lateral plate and supports other body being against the one body rotatably. The second supporting body is swingably supported to the lateral plate and includes a rotatable roller. The tensile spring is connected between the first supporting body and the second supporting body at its both ends to pull the first supporting body to a side of the second supporting body. The eccentric cam is rotatably supported at a position between the first supporting body and the second supporting body in the lateral plate, in which a through hole and a depression having an inclined bottom face along a circumference direction are formed, comes into contact with the roller and is rotated in a positive rotation direction to change a posture of the second supporting body and to extend and contract the tensile spring, and thereby, changes a nip pressure of the nip from a first pressure to a second pressure lower than the first pressure. The rotating shaft goes through the through hole. The protrusion is fixed to the rotating shaft, is in a protrusion direction of a diameter direction of the rotating shaft and comes into contact with the bottom face. The driving part includes a gear train connected to the rotating shaft to transmit torque rotating the eccentric cam to the rotating shaft and a driving source driving the gear train. The pressing member is fitted to the rotating shaft and presses the eccentric cam from an opposite side to the protrusion across the bottom face. The bottom face is inclined so as to gradually deepen from an upstream side to a downstream side in the positive rotation direction of the eccentric cam.

In accordance with the present disclosure, an image forming apparatus includes a forming part forming a toner image onto a medium; and the above-described fixing device fixing the toner image formed on the medium by the forming part to the medium.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
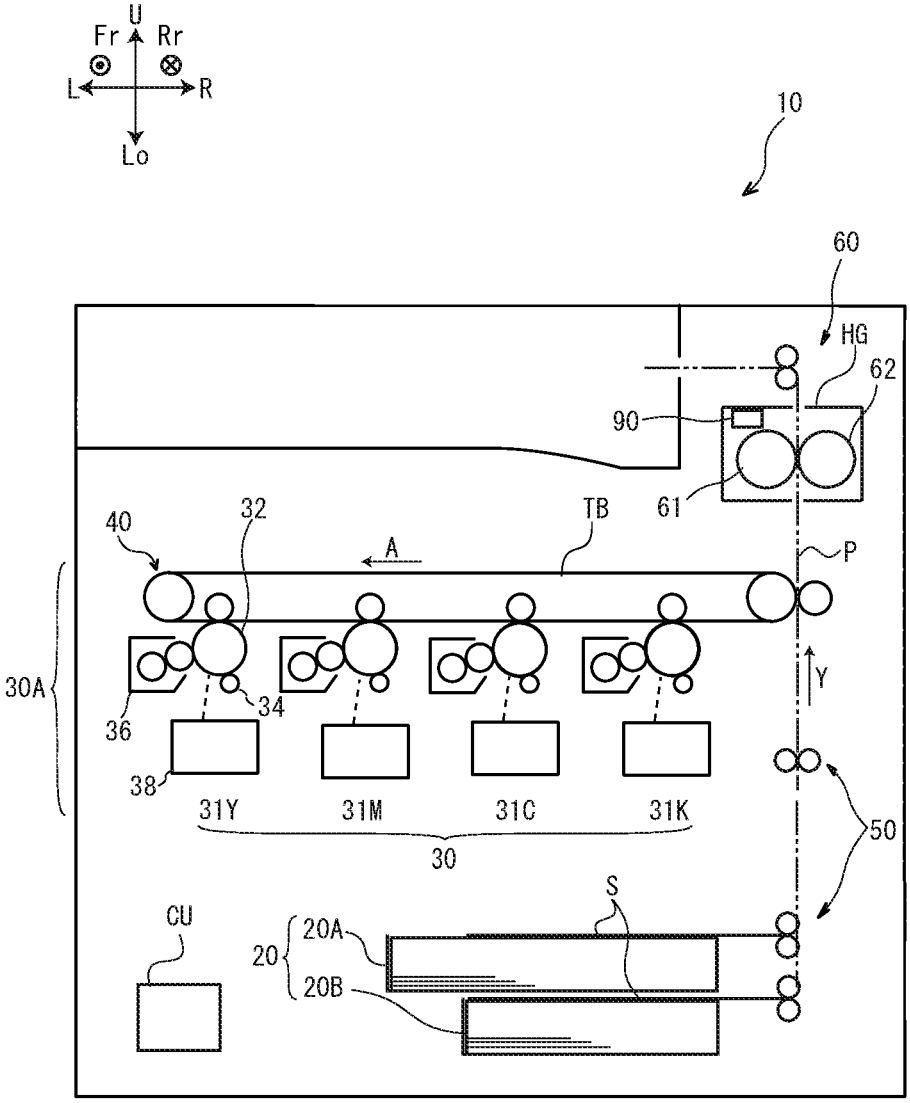
FIG. 1 is a front sectional view schematically showing an image forming apparatus according to an embodiment of the present disclosure.

Hereinafter, entire structure of an image forming apparatus 10 (refer to FIG. 1) according to an embodiment and image forming operation of the image forming apparatus 10 will be described with reference to the drawings. In addition, structure of a fixing device 60 (refer to FIGS. 3-9) as a main component of the embodiment and changing operation of a nip pressure of the fixing device 60 will be described with reference to the drawings. The changing operation of the nip pressure is operation for changing the nip pressure between a heating roller 61 and a pressuring roller 62 composing the fixing device 60 when the image forming operation is carried out in the image forming apparatus 10. Furthermore, effects of the embodiment will be described with reference to the drawings in order of description.

In the following description, arrows Fr and Rr in the drawings respectively correspond to a near side and a far side in an apparatus depth direction, arrows R and L in the drawings respectively correspond to a right side and a left side in an apparatus width direction, and arrows U and Lo in the drawings respectively correspond to an upper side and a lower side in an apparatus height direction. The specification will be described so that a state of the image forming apparatus 10 as viewed from the near side in the apparatus depth direction is estimated to be a front side of the image forming apparatus 10.

Firstly, the entire structure of the image forming apparatus 10 will be described. The image forming apparatus 10 is an electrographic type apparatus configured to, as shown in FIG. 1, include a sheet feeding cartridge 20, a toner image forming part 30, a transferring device 40, a conveying device 50, the fixing device 60 and controlling part CU.

The sheet feeding cartridge 20 has a function containing a so-called plain paper, an envelope and other mediums S. The sheet feeding cartridge 20 is located at a lower side inside the image forming apparatus 10 in the apparatus height direction. The sheet feeding cartridge 20 is composed of, as one example, a first sheet feeding cartridge 20A and a second sheet feeding cartridge 20B. The first sheet feeding cartridge 20A contains the plain paper and the second sheet feeding cartridge 20B contains another cardboard (a thicker paper than the plain paper), such as the envelope. Moreover, containing of the plain paper in the first sheet feeding cartridge 20A and containing of the cardboard in the second sheet feeding cartridge 20B (hereinafter, called as containing information) are inputted from a user interface UI (refer to FIG. 10) provided in the image forming apparatus 10 by a worker, and then, stored in a storing part RAM (refer to FIG. 10) provided in the controlling part CU described later.

The toner image forming part 30 has a function carrying out respective steps of electric charging, exposing and developing to form a toner image carried on a belt TB described later. The toner image forming part 30 is composed of single color units 31Y, 31M, 31C and 31K respectively forming toner images of different colors (Y (yellow), M (magenta), C (cyan) and K (black)). Each of the single color units 31Y, 31M, 31C and 31K includes a photosensitive body 32, a charging device 34 an exposing device 36 and a developing device 38. Incidentally, in FIG. 1, reference signs of components of the single color units 31M, 31C and 31K other than the single color unit 31Y are omitted. Moreover, the toner image forming part is located at a center inside the image forming apparatus 10 in the apparatus height direction.

The transferring device 40 includes the endless belt TB and has a function primarily transferring the toner image formed by the toner image forming part 30 onto the rotating belt TB (in an arrow A direction in FIG. 1) and secondarily transferring the toner image carried on the belt TB onto the medium S. The transferring device 40 is located above the toner image forming part 30 and at the center inside the image forming apparatus 10 in the apparatus height direction.

The conveying device 50 has a function conveying the medium S contained in the sheet feeding cartridge 20 along a conveying path (a two-dot chain line P in FIG. 1). Incidentally, an arrow Y in FIG. 1 indicates a conveying direction of the medium S.

The fixing device 60 has a function fixing the toner image secondarily transferred on the medium S by the transferring device 40 onto the medium S. The fixing device 60 is located above the transferring device 40 in the apparatus height direction and at a right side as viewed from a front side of the image forming apparatus 10. The fixing device 60 will be described in detail later.

Figure 13:
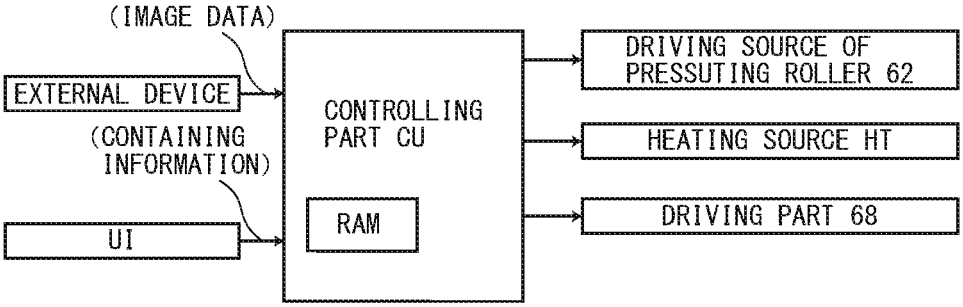
FIG. 13 is a block diagram showing a relationship of a controlling part composing the image forming apparatus and each component composing the fixing device according to the embodiment.

The controlling part CU has a function control each component composing the image forming apparatus 10 (refer to FIGS. 2 and 13 described later). The function of the controlling part CU will be described in the later description of image forming operation and changing operation of a nip pressure of the fixing device 60.

Each component of the image forming apparatus 10 was described above, and further, combination (hereinafter, called as a forming part 30A) of the toner image forming part 30 and the transferring device 40 can be regarded to have a function forming the toner image onto the medium S.

Next, the image forming operation of the image forming apparatus 10 of the embodiment will be described with reference to FIGS. 1 and 2.

The controlling part CU, when receiving image data from an external device (not shown) and receiving job data having data of the medium S as an image formed object and other data, operates each component of the image forming apparatus 10.

Figure 2:
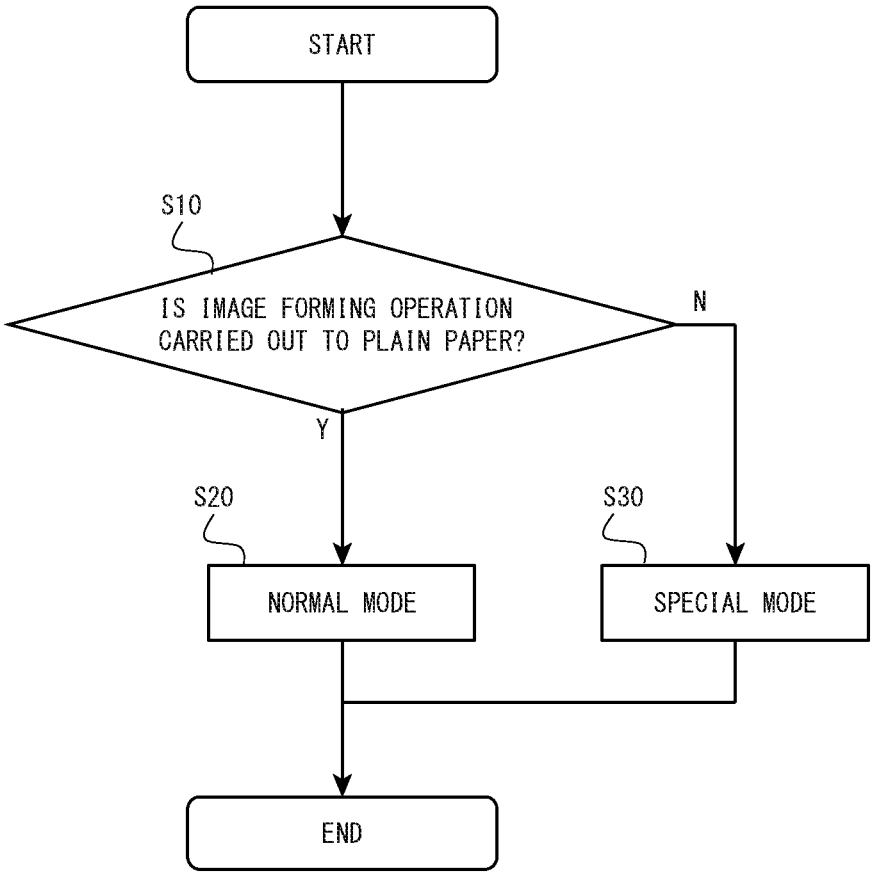
FIG. 2 is a chart showing a control flow of changing operation of a nip pressure between a heating roller and a pressuring roller of a fixing device in the image forming apparatus according to the embodiment.

Here, the controlling part CU, in accordance with a control flow shown in FIG. 2, decides at a decision step S10, whether or not the medium S as the image formed object is the plain paper. As a result, if decision of the controlling part CU is positive, the controlling part CU selects a normal mode at a step S20 to make the image forming apparatus 10 carry out the image forming operation using the plain paper contained in the first sheet feeding cartridge 20A. By contrast, if decision of the controlling part CU is negative, the controlling part CU selects a special mode at the step S20 to make the image forming apparatus 10 carry out the image forming operation using the envelope contained in the second sheet feeding cartridge 20B.

Then, when the toner image forming part 30 is operated, in each of the single color units 31Y, 31M, 31C and 31K, the charging device 34 electrically charges the photosensitive body 32, the exposing device 36 exposes the photosensitive body 32 to form a latent image on the photosensitive body 32, and the developing device 38 develops the latent image on the photosensitive body 32 to the toner image. As a result, the toner image is formed on the photosensitive body 32.

Subsequently, when the transferring device 40 and the conveying device 50 are operated, the toner image formed by the toner image forming part 30 is primarily transferred onto the belt TB. Moreover, at a timing when the toner image primarily transferred on the belt TB is secondarily transferred, the medium S contained in the sheet feeding cartridge 20 is conveyed by the conveying device 50, and then, the toner image carried by the belt TB is secondarily transferred onto the medium S. The medium S with the secondarily transferred toner image is conveyed to the fixing device 60 by the conveying device 50.

After that, when the fixing device 60 is operated and the medium S with the secondarily transferred toner image is conveyed to the fixing device 60, the toner image secondarily transferred on the medium S is fixed onto the medium S (the image is formed on the medium S). Incidentally, the normal mode and the special mode are different in the nip pressure between the heating roller 61 and the pressuring roller 62 and its detail will be described in the description of the changing operation of the nip pressure of the fixing device 60.

Further, the medium S with the fixed toner image (the medium S on which the image is formed) is ejected to the outside of the image forming apparatus 10 by the conveying device 50, and then, the image forming operation is completed.

Next, the structure of the fixing device 60 as a main component of the embodiment will be described in detail with reference to FIGS. 3-12B.

The fixing device 60 is configured to include a housing HG, the heating roller 61 (one example of a heating body), a heating source HT, the pressuring roller (one example of a pressuring body), lateral plates 63, first supporting bodies 64, coil springs CS1, second supporting bodies 65, tensile springs ES, eccentric cams 66, a shaft 67 (one example of a rotating shaft), coil springs CS2 (one example of a pressing member) and a driving part 68. The housing HG, the heating roller 61, the heating source HT, the pressuring roller 62 and the shaft 67 have respective longitudinal sizes and are arranged in a state that respective longitudinal directions are parallel to the apparatus depth direction. Moreover, the fixing device 60 has a longitudinal size and is attached to a main body of the image forming apparatus 10 in a state that its longitudinal direction is parallel to the apparatus depth direction (refer to FIG. 1). Incidentally, the lateral plates 63, the first supporting bodies 64 and the second supporting bodies 65 are respectively paired at both end sides in the longitudinal direction of the image forming apparatus 10 (are configured as respective pairs).

The housing HG has a function housing components composing the fixing device 60 other than the housing HG in its inside. The housing HG is formed, as one example, in a rectangular shape as viewed from the front side of the image forming apparatus 10. At a lower side of the housing HG, an inlet HG1 is formed into which the medium S conveyed in the conveying path P by the conveying device 50 is inputted. At an upper side of the housing HG, an outlet HG2 is formed into which the medium S conveyed in the conveying path P by the conveying device 50 is outputted from the fixing device 60.

Figure 6:
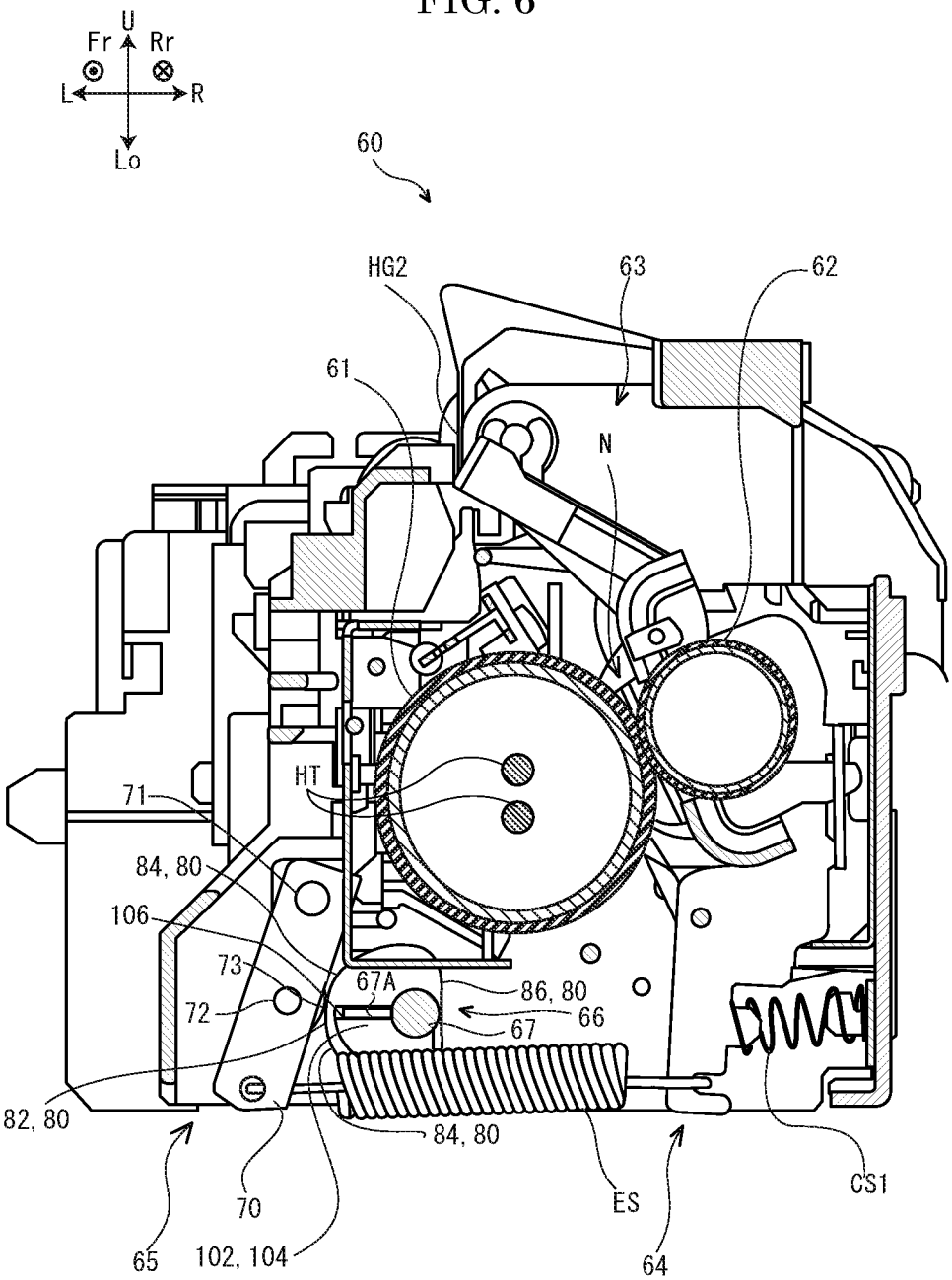
FIG. 6 is a partially sectional view (a sectional view as viewed from a longitudinal direction) showing the fixing device, in a normal mode, according to the embodiment.
Figure 7:
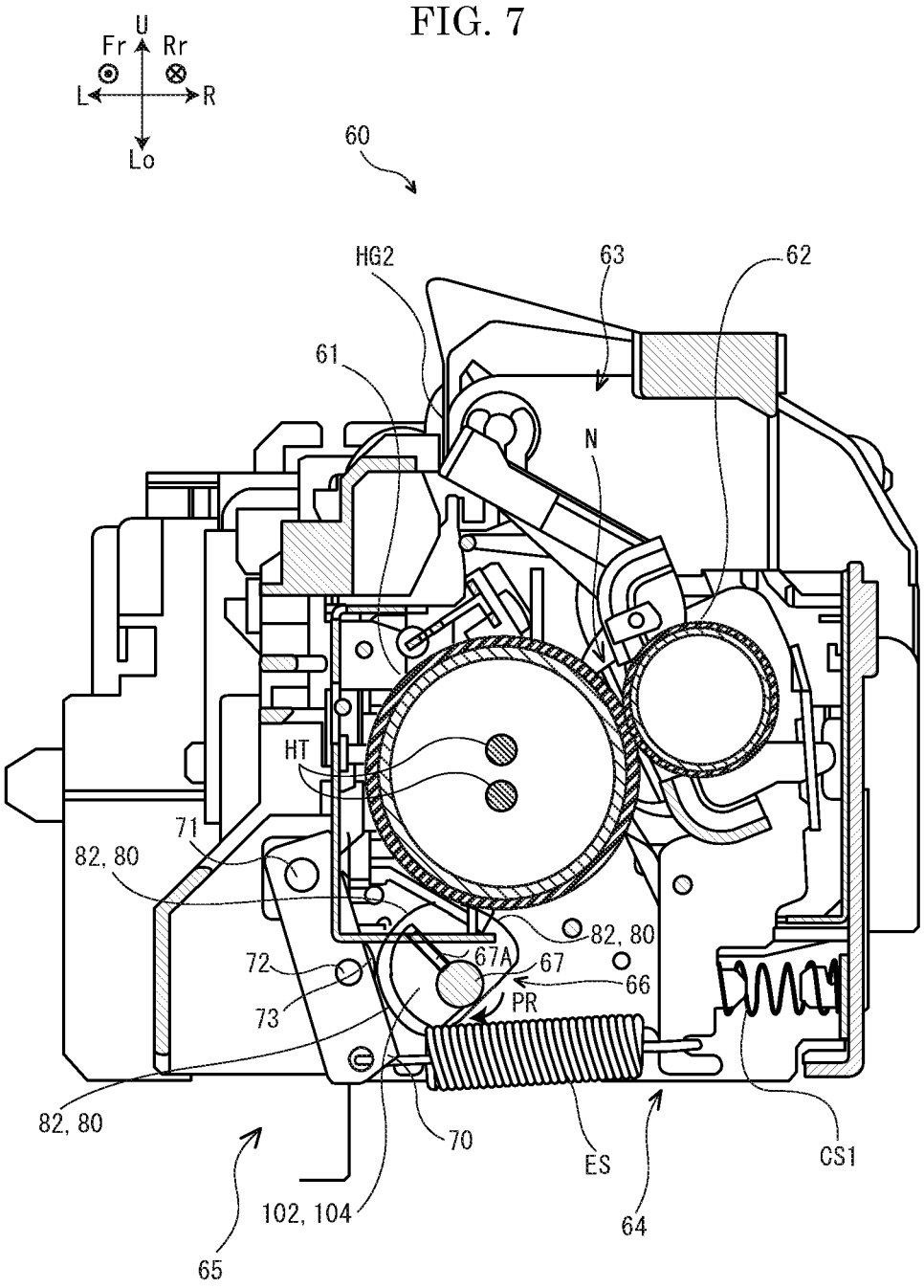
FIG. 7 is a partially sectional view (a sectional view as viewed from a longitudinal direction) showing the fixing device, when the nip pressure is changed from the normal mode to a special mode, according to the embodiment.

The heating roller 61 has a function heating the toner image (a toner composing it) formed on the medium S by the forming part 30A and the medium S. The heating roller 61 is, as shown in FIGS. 6 and 7, a rubber roller in which an outer circumference of a metal pipe is coated by rubber. The heating roller 61 is located at a center of the fixing device 60 (a center in the housing HG) as viewed from a front side. The heating roller 61 is heated to a predetermined temperature by the heating source HT described later, and simultaneously, rotated by following to the pressuring roller 62 described later. Moreover, the heating roller 61 pressures, with the pressuring roller 62 at a nip N described later, the medium S having the formed toner image conveyed by the conveying device 50. As a result, the heating roller 61 rotates around an axis (rotates in a counter clockwise direction as viewed from the front side), and simultaneously, comes into contact with the medium S having the formed toner image to heat the medium S, and thereby, fixes the toner image onto the medium S passing through the nip N with the pressuring roller 62.

The heating source HT is, as one example, a halogen lamp. The heating source HT is, as shown in FIGS. 6 and 7, located inside the heating roller 61.

Incidentally, in parts at both ends of the heating roller 61, flanges (not shown) are fitted and fixed. Moreover, the respective flanges are rotatably supported to a pair of lateral plates 63 described later.

The pressuring roller 62 has a function pressuring, with the heating roller 61, the toner image (the toner composing it) formed by the toner image forming part 30 and secondarily transferred on the medium S by the transferring device 40 and the medium S, on other words, the toner image (the toner composing it) formed on the medium S by the forming part 30A (refer to FIG. 1) and the medium S. The pressuring roller 62 is a rubber roller in which an outer circumference of a metal shaft is coated by rubber. The pressuring roller 62 is, as shown in FIGS. 6 and 7, located at a right side of the heating roller 61 as viewed from a front side. Moreover, the pressuring roller comes into contact with the heating roller 61. Incidentally, the above nip N indicates a contact portion of the heating roller 61 and the pressuring roller 62 formed by the heating roller 61 and the pressuring roller 62.

To one end of the metal shaft of the pressuring roller 62, a driving source (not shown) is connected. Moreover, the pressuring roller 62 is driven by the driving source and rotated around an axis (rotated in a clockwise direction as viewed from the front side) to rotate the heating roller 61.

Figure 5:
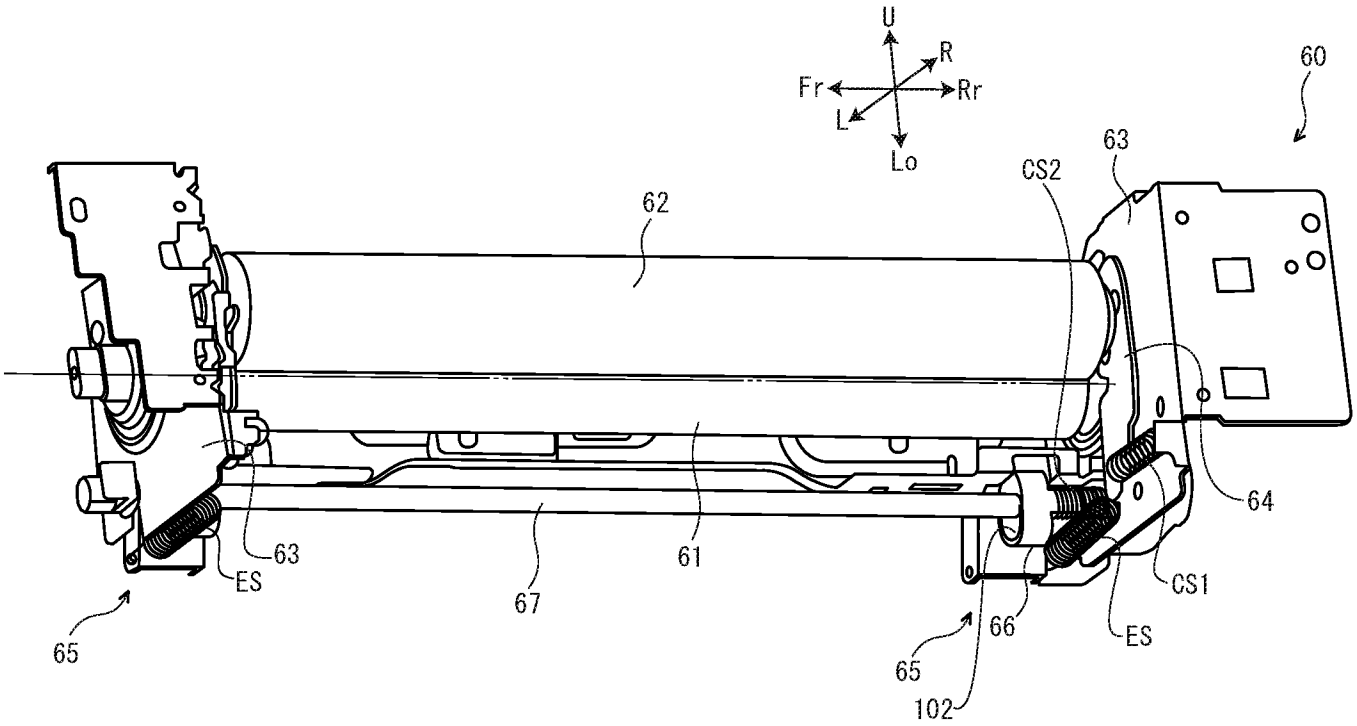
FIG. 5 is a perspective view showing the fixing device, in a state that a housing is detached (a state that the housing is removed), according to the embodiment.

The lateral plates 63 have, as shown in FIG. 5, a function supporting the heating roller 61 as being rotatable around the axis. Incidentally, as described above, in the lateral plates 63, through holes are formed and, into the through holes, the flanges fixed to both end sides of the heating roller 61 are fitted.

Figure 8:
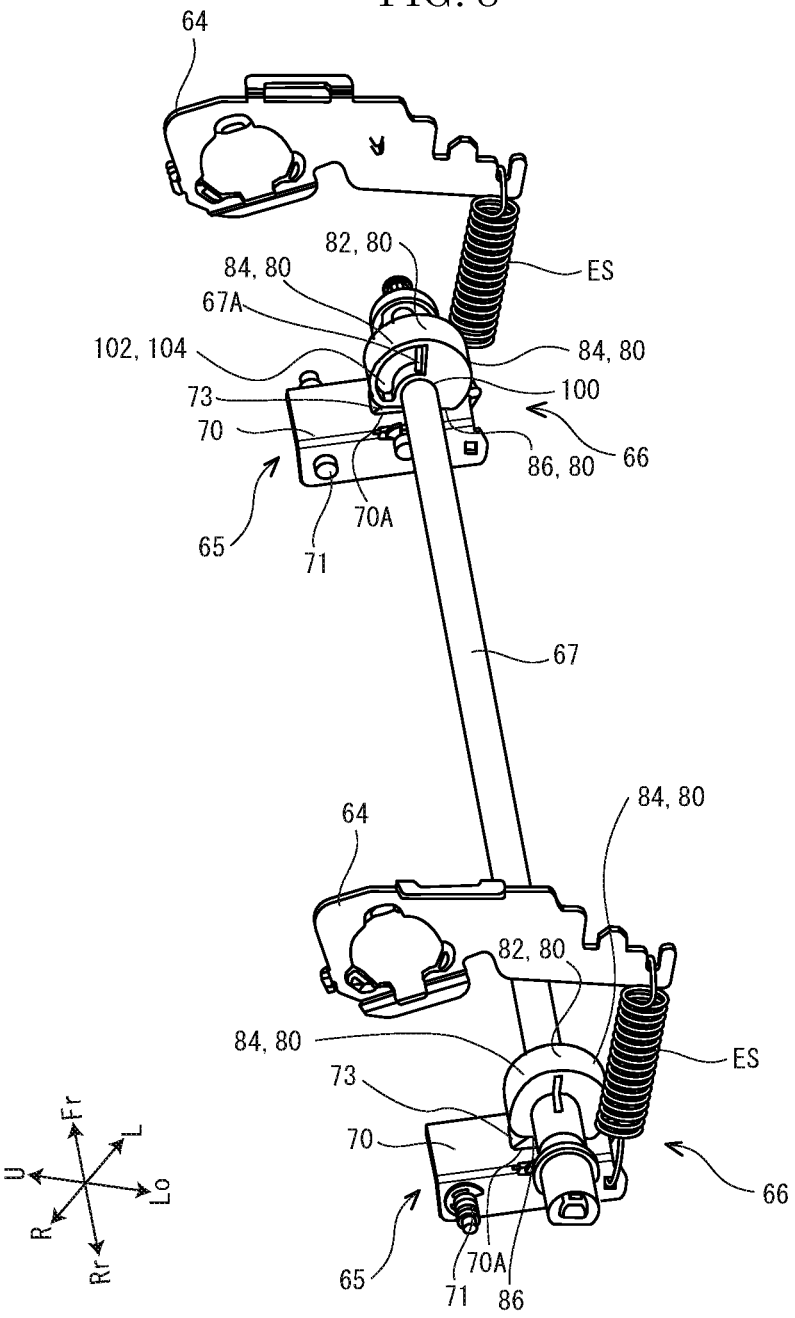
FIG. 8 is a perspective view showing an eccentric cam and peripheral components of the fixing device, in the special mode, according to the embodiment.

The first supporting bodies 64 have a function supporting the pressuring roller 62 as being rotatable around the axis. The first supporting bodies 64 are, as shown in FIGS. 6-8, made of longitudinal metal plates. Moreover, the first supporting bodies 64 are located at opposite sides to the heating roller 61 across the nip N. One end sides (upper sides) of the first supporting bodies are swingably supported to the through holes of the lateral plates 63 by pins. In addition, other end sides (lower sides) of the first supporting bodies 64, projections are formed. Then, the first supporting bodies 64 are pressed by the coil springs CS compressed by and fitted to the projections and protrusions of the lateral plates 63. As a result, the pressuring roller 62 supported by the first supporting bodies 64 comes into contact with the heating roller 61 to form the nip N (as shown in FIGS. 6 and 7). Incidentally, the respective first supporting bodies 64 are located at the inside of the pair of the lateral plates 63 (at facing sides of the pair of the lateral plates 63).

The second supporting bodies 65 are, as shown in FIGS. 6 and 7, located at opposite sides to the pressuring roller 62 across the nip N (or the heating roller 61) and at a lower side from the pressuring roller 62. The second supporting bodies 65 are configured to include cases 70, first pins 71, second pins 72 and rollers 73, respectively. On other words, each second supporting body 65 is provided with the roller 73.

The case 70 is, as shown in FIG. 8, a longitudinal member so that a cross section as viewed from a longitudinal direction is a U-shape. In one end side and a center side in a longitudinal direction of the case 70, through holes going through its facing walls are formed. Then, the case 70 is swingably supported to the lateral plate 63 by fitting the first pin 71 into the through hole at the one end side in the longitudinal direction and fitting the first pin 71 into the through hole formed in the lateral plate 63. Incidentally, the respective cases are located at the inside of the pair of the lateral plates 63 (at facing sides of the pair of the lateral plates 63). Moreover, at the center in the longitudinal direction in a wall connecting the facing walls of the case 70, a through hole 70A in a rectangular shape as viewed in a thickness direction of the wall is formed (refer to FIG. 8).

The second pin 72 is, as shown in FIGS. 6-8, fitted into the through hole formed at the center in the longitudinal direction of the case 70 and fixed in a state connecting the facing walls of the case 70. Moreover, at the center in a longitudinal direction of the second pin 72, the roller 73 is located as being rotatable around an axis. Incidentally, between the roller 73 and the facing walls of the case 70, as one example, a pair of coil springs (not shown) in compressed states are fitted to the second pin 72, but its illustration is omitted. Therefore, the roller 73 is pressed from both sides in the thickness direction by the pair of coil springs to be positioned at the center in the longitudinal direction of the second pin 72.

The tensile springs ES are, as shown in FIGS. 6 and 7, suspended by parts in which through holes are formed at lower sides (opposite sides to fulcrum sides of swinging) of the first supporting bodies 64 and parts in which through holes are formed at lower sides (opposite sides to fulcrum sides of swinging by fitting the first pins 71) of the cases 70. On other words, both end sides of the tensile spring ES are connected to the first supporting body 64 and the second supporting body 65. Moreover, the tensile spring ES is extended more than its natural length in a situation in which the eccentric cam 66 described later comes into contact with the roller 73 of the second supporting body 65 and presses the roller 73. Therefore, the tensile spring ES pulls the first supporting body 64 to a side of the second supporting body 65.

The eccentric cams 66 have a function rotating around an axis to swing the second supporting bodies 65. On other words, the eccentric cam 66 has a function rotating around the axis to change a posture of the second supporting body 65 and to extend and contract the tensile spring ES. The eccentric cam 66 is, as shown in FIGS. 3, 5-8, 11A and 11B, fitted to an outer circumference of the shaft 67 and fixed to the outer circumference at both end sides of the shaft 67 (at a side of an end in an axis direction of the shaft 67). The shaft 67 is, as shown in FIG. 5, fitted into the through holes formed in the pair of the lateral plates 63 to be rotatable around an axis. Then, each eccentric cam 66 is, as shown in FIGS. 6 and 7 arranged, in a state supported by the shaft 67 at a position between the first supporting body 64 and the second supporting body 65 in each lateral plate 63, so that its outer circumference face 80 comes into contact with the roller 73 of each second supporting body 65.

Figure 9:
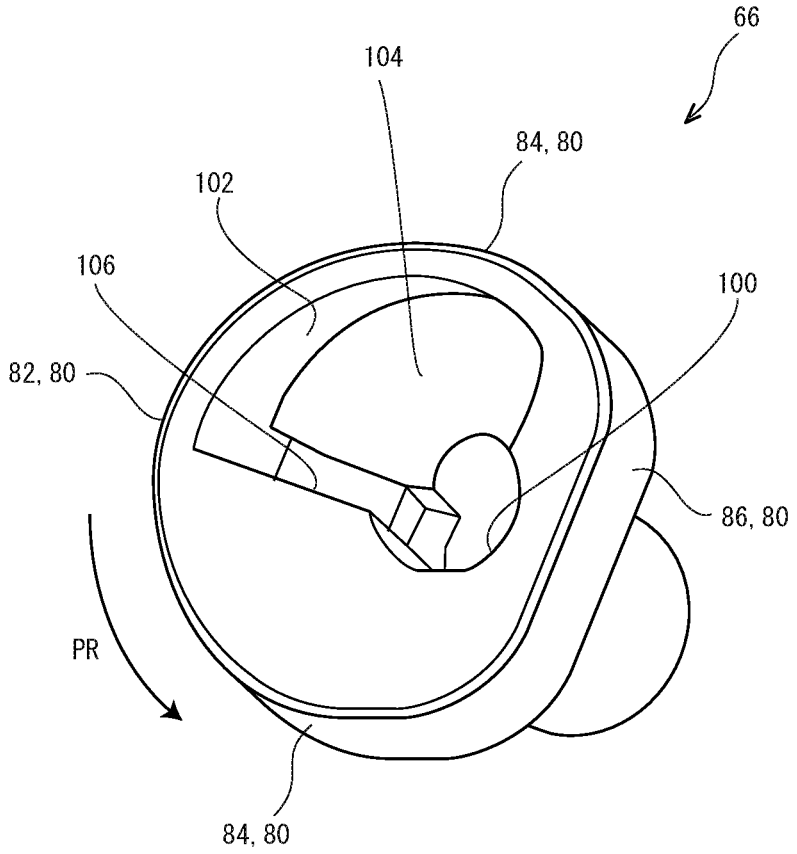
FIG. 9 is a perspective view showing the eccentric cam composing the fixing device according to the embodiment.
Figure 10:
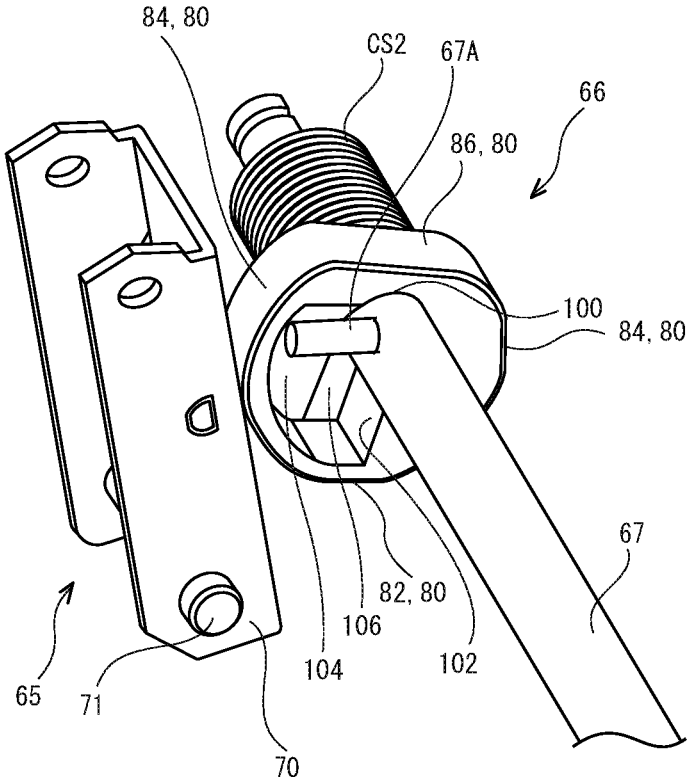
FIG. 10 is a perspective view showing the eccentric cam and a second supporting body composing the fixing device according to the embodiment.
Figure 11A:
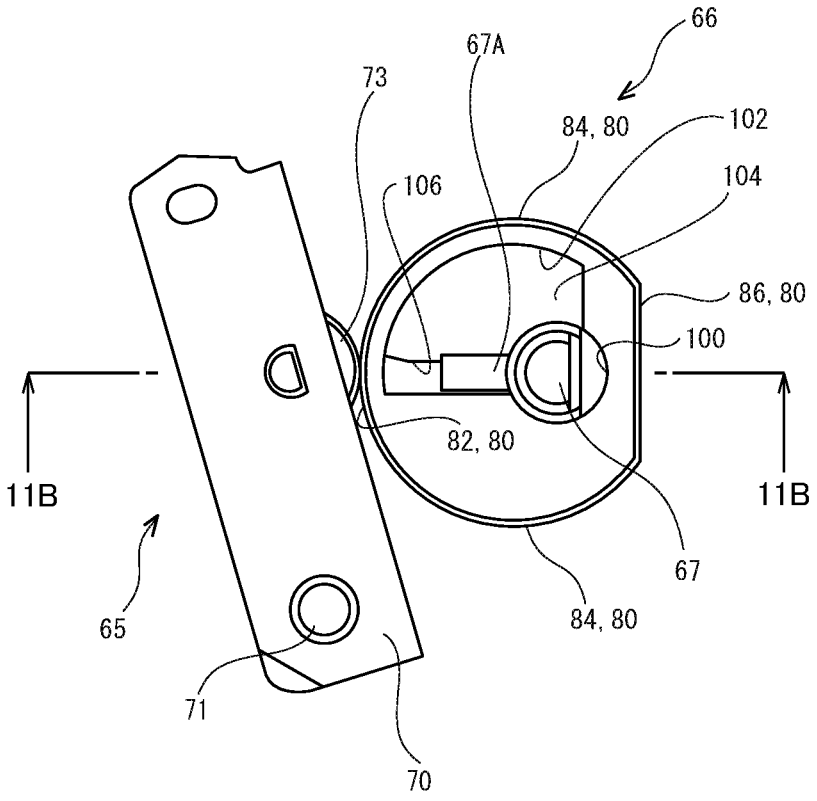
FIG. 11A is a front view showing the eccentric cam and the second supporting body composing the fixing device according to the embodiment.

The eccentric cam 66 is, as shown in FIGS. 6-10, a member in a semi-elliptic shape as a portion cut out along a minor axis of an ellipse as viewed in an orthogonal direction (corresponding to an axis direction of the shaft 67) to its rotation direction. That is, the eccentric cam 66 is a line symmetry member as viewed in the orthogonal direction to its rotation direction and a portion (a one-dot chain line in FIG. 11) crossing a symmetry axis in the outer circumference face 80 and its peripheral portion (plus or minus 5 angles with respect to the symmetry axis) are arranged at a constant distance from a rotation axis of the eccentric cam 66. In the following description, the portion crossing the symmetry axis in the outer circumference face 80 and its peripheral portion (plus or minus 5 angles with respect to the symmetry axis) are called as a first face 82 (one example of a first portion making a first pressure described later of the nip pressure of the nip N). Moreover, portions from ends of the first face 82 to 90 angles with respect to the symmetry axis in the outer circumference face 80 are called as second faces 84. Further, a face other than the first face 82 and the second faces 84 in the outer circumference face 80, i.e. an opposite face to the first face 82 in a direction of the symmetry axis, is called as a third face 86. The third face 86 is, as shown in FIGS. 9 10 and 11A, formed in a plain face.

Figure 11B:
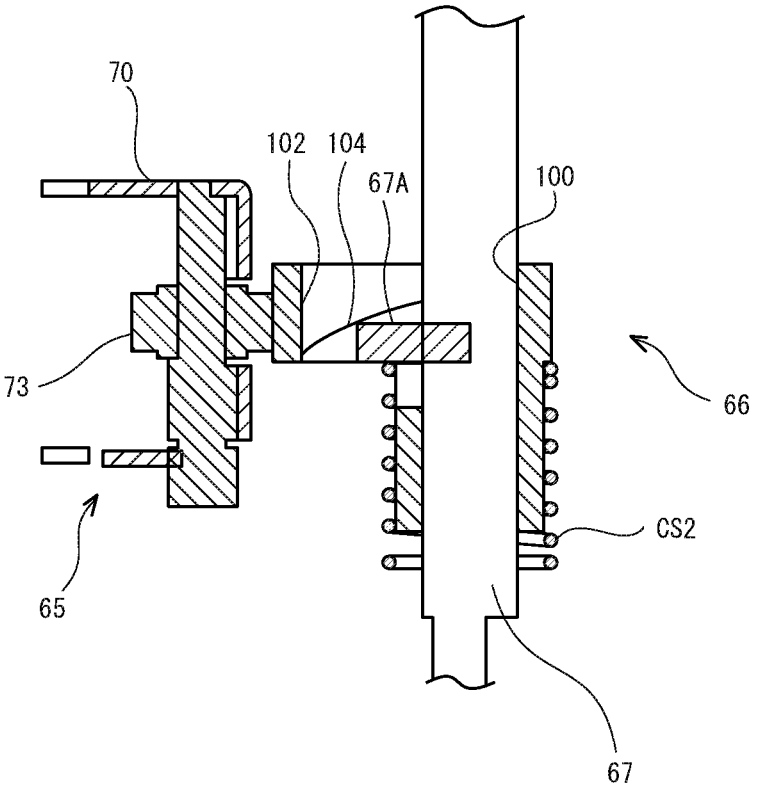
FIG. 11B is a sectional view showing the eccentric cam and the second supporting body along a line of 11B-11B in FIG. 11A.

As described above, the eccentric cams 66 are fitted to the outer circumference of the shaft 67, concretely, in the eccentric cams 66, through holes 100 going through in a orthogonal direction to its rotation direction are formed and, into the through holes 100, the eccentric cams 66 are fitted (refer to FIGS. 8, 10 and 11B).

In the respective eccentric cams 66, as shown in FIG. 9, fan-shaped depressions 102 depressed in a orthogonal direction (an axis direction of the shaft 67) to its rotation direction are formed. The depression 102 is formed at facing sides of the eccentric cams 66 (at a center side in an axis direction of the shaft 67). Each of bottom faces 104 of the depressions 102 is an inclined face so that its depth is gradually deepened along a rotation direction of the eccentric cam 66 (or a circumference direction of the eccentric cam 66) (hereinafter, the bottom faces 104 are called as inclined faces 104). Then, the inclined face 104 formed, with respect to a relationship with a positive rotation direction of the eccentric cam 66 (a direction indicated by an arrow PR in FIGS. 7 and 9) described later, so that the depth is gradually deepened from an upstream side to a downstream side in the positive rotation direction, that is, a forward side in the positive rotation direction is more deepened. Moreover, in ends at the downstream side in the positive rotation direction in the inclined faces 104, through holes 106 (one example of a hole) are formed so that parts of pins 67A (refer to FIGS. 10 and 12B) described later is extended to the outside of the depressions 102 (the outside in the axis direction).

Figure 12A:
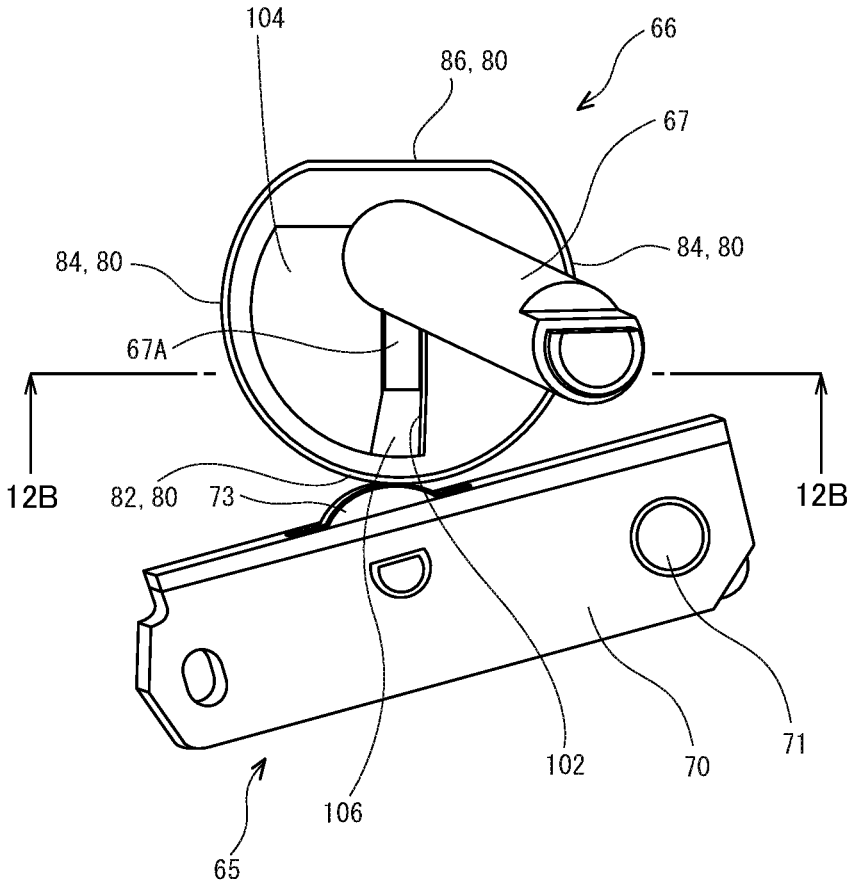
FIG. 12A is a perspective view showing the eccentric cam and the second supporting body composing the fixing device according to the embodiment.
Figure 12B:
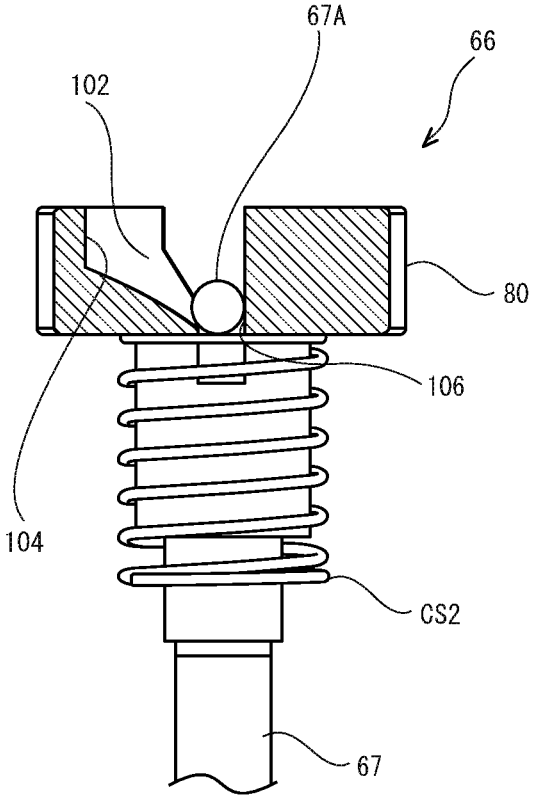
FIG. 12B is a perspective view showing the eccentric cam and the second supporting body along a line of 12B-12B in FIG. 12A.

The second faces 84 will be described as follows. Each of the second faces 84 is, as shown in FIG. 12A, formed so that its distance from the rotation axis of the eccentric cam 66 is gradually shortened from a border with the first face 82 (one end at a side of the first face 82) to an opposite end, i.e. a border with the third face 86. In the following description, as shown in FIG. 6, a state that the eccentric cam 66 comes into contact with the roller 73 by the first face 82 is an initial position of the eccentric cam 66. Moreover, as shown in FIG. 8, a state that the eccentric cam 66 comes into contact with the roller 73 by the third face 86 is a special position of the eccentric cam 66. Further, the nip pressure of the nip N in the initial position of the eccentric cam 66 is the first pressure and the nip pressure of the nip N in the special position of the eccentric cam 66 is the second pressure. The second pressure is set lower than the first pressure. Then, the eccentric cam 66 becomes from a state of the initial position (refer to FIG. 6) to a state of the special position (refer to FIG. 8), and thereby, the nip pressure is changed from the first pressure to the second pressure. In such a case, the eccentric cam 66 rotates in the positive rotation direction of the arrow PR shown in FIG. 7.

At both end sides of the shaft 67, as shown in FIG. 10, pins 67A (one example of protrusion) protruding in a protrusion direction of a diameter direction of the shaft 67. The pins 67A are, as shown in FIGS. 10, 11A and 11B, set so as to be positioned inside the depressions 102.

Moreover, as shown in FIGS. 5 and 10, at opposite sides to the pins 67A across the inclined faces 104 of the eccentric cams 66 in the shaft 67, coil springs CS2 are fitted. The coil spring CS2 is in a state clamped and compressed between the lateral face 63 and the eccentric cam 66. That is, the coil spring CS2 presses the eccentric cam 66 from an end side to a center side of the shaft 67. Therefore, the pin 67A in the depression 102 comes into contact with the inclined face 104 (from the center side in the axis direction of the shaft 67) by pressing the eccentric cam 66 with the coil spring CS2. As a result, a position of the eccentric cam 66 with respect to the shaft 67 is defined by the coil spring CS2 and the pin 67A.

In the embodiment, when the shaft 67 is rotated around the axis by the driving part 68 described later, the eccentric cam 66 is rotated around the axis. Concretely, the shaft 67 is set so as to stop after rotating by 180 degrees in the positive rotation direction (the clockwise direction) as viewed from a front side with respect to a standard (zero agree) as being the initial position of the eccentric cam 66. In such a case, according to the positive rotation of the shaft 67, the pins 67A are rotated in the positive rotation direction (refer to FIG. 7). At that time, for example, when the pin 67A starts to rotate from a position other than both ends in the rotation direction of the inclined face 104, the pin 67A slips on the inclined face 104 and moves to a most downstream side in the depression 102 in the positive rotation direction to meet an end face of the depression 102 in the rotation direction. Then, the pin 67A rotates in the positive rotation direction according to the positive rotation of the shaft 67, and simultaneously, presses the above-described end face of the eccentric cam 66. As a result, the eccentric cam 66 rotates according to the rotation of the shaft 67. Moreover, the eccentric cam 66 rotates in a state that its position in the shaft 67 is defined by being clamped between the pin 67A and the coil spring CS2 during a period changing its posture from the initial position to the special position. Incidentally, as the posture of the eccentric cam 66 is changed from the initial position to the special position, a portion at the lower end side of the case 70 is pulled by the tensile spring ES (the tensile spring ES is contracted), and then, a posture of the second supporting body 65 is changed (refer to FIGS. 6 and 7).

Figure 3:
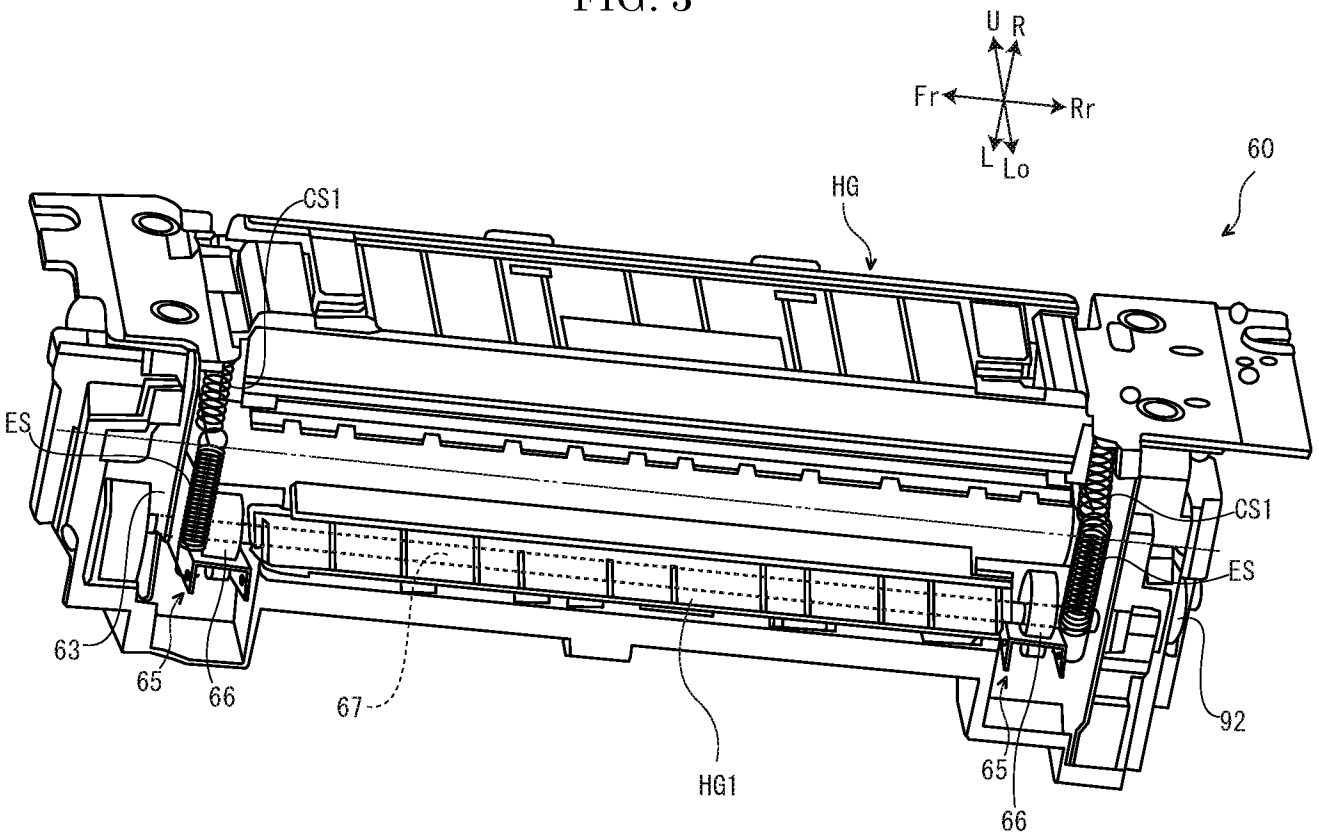
FIG. 3 is a perspective view showing the fixing device, as viewed from a right lower side, according to the embodiment of the present disclosure.
Figure 4:
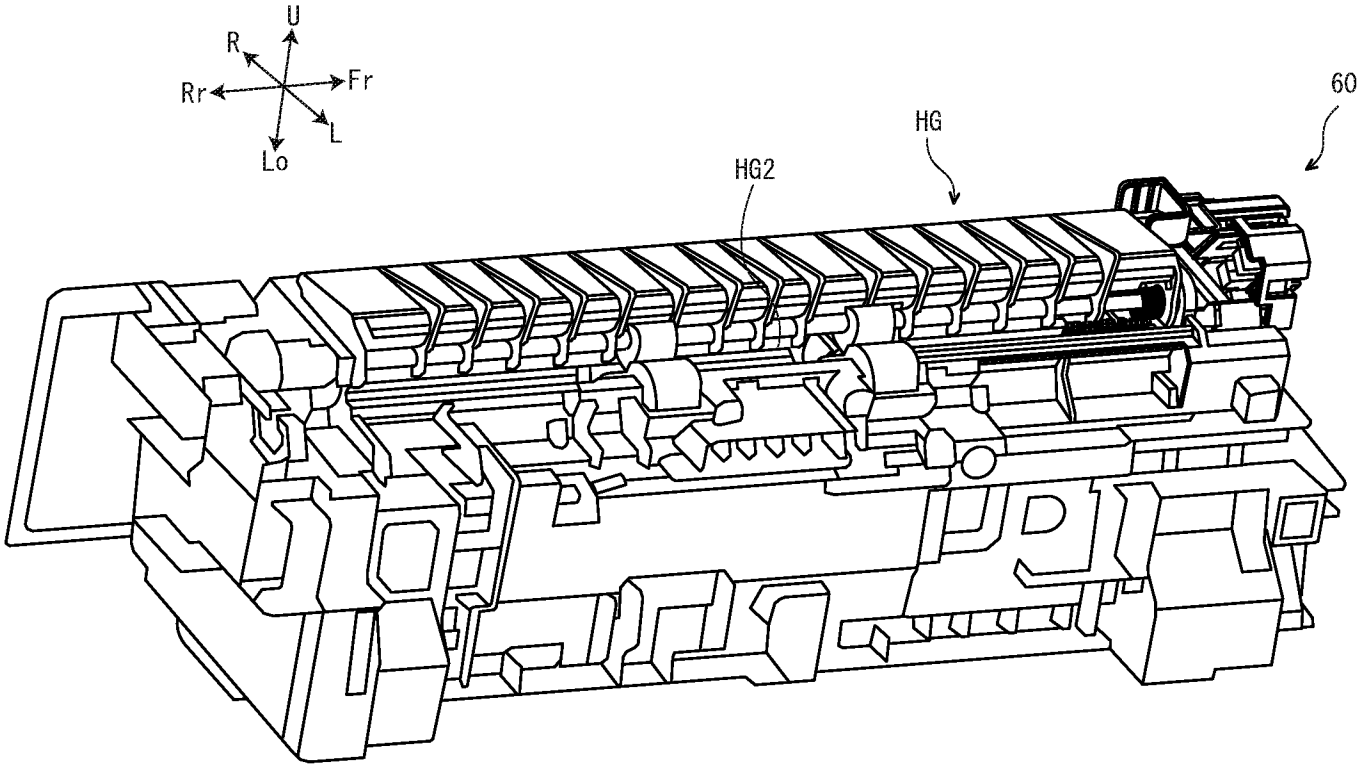
FIG. 4 is a perspective view showing the fixing device, as viewed from a left upper side, according to the embodiment of the present disclosure.

The driving part 68 has a function rotating the shaft 67 going through the eccentric cam 66. The driving part 68 is configured to include a driving source 90 (refer to FIG. 1) and a gear train 92 (refer to FIG. 3 and FIG. 3 illustrates a part of the gear train 92).

The driving source 90 has a function driving the gear train 92. The driving source 90 is, as one example, a motor. The gear train 92 is an assembly of a plurality of gears. The gear train 92 is connected to a gear (not shown) fixed to one end side of the shaft 67. Moreover, the gear train 92 is driven by the driving source 90 to rotate the shaft 67 around the axis. On other words, the gear train 92 is connected to the eccentric cam 66 via the shaft 67 and the gear of the shaft 67 to have a function transmitting a torque rotating the eccentric cam 66 around the axis to the eccentric cam 66.

Next, the changing operation of the nip pressure of the fixing device 60 will be described with reference to FIGS. 2, 6-8, 10, 11A, 11B, 12A, 12B and 13. Incidentally, operation of the fixing device 60 is carried out in the image forming operation of the above-described image forming apparatus 10. Moreover the posture of the eccentric cam 66 of the fixing device 60 is positioned at the above-described initial position (refer to FIG. 6) for a period the image forming operation (fixing operation) is not carried out.

The controlling part CU transmits a remote signal to the fixing device 60 (refer to FIG. 13) when receiving the job data from the external device (not shown).

Moreover, the controlling part CU drives the driving source (not shown) of the pressuring roller 62 to rotate the pressuring roller 62 around the axis by a predetermined rotation speed. According to this, the heating roller 61 is rotated by a predetermined rotation speed by following to the pressuring roller 62. In addition, in order to heat the heating roller 61, the heating source HT is activated.

Further, the controlling part CU, in accordance with the control flow shown in FIG. 2, decides at the decision step S10, whether or not the medium S as the image formed object is the plain paper. Then, if decision of the controlling part CU is positive (i.e. it is decided that the medium S is the plain paper), the controlling part CU selects the normal mode at the step S20 to carry out the fixing operation at a state of the initial position of the eccentric cam 66. FIG. 6 shows the fixing device 60 at the normal mode.

By contrast, if decision of the controlling part CU at the decision step S10 is negative (it is decided that the medium S is the envelope (one example of the cardboard)), the controlling part CU selects the special mode at the step S30. In such a case, the controlling part CU rotates the eccentric cam 66 in the positive rotation direction as viewed from the front side with respect to the initial position as the standard (refer to FIG. 8), and then, makes the fixing device 60 carry out the fixing operation. As described above, when the controlling part CU sets a mode of the fixing operation to any one of the normal mode and the special mode, and then, the medium S having the formed toner image is sent to the fixing device 60, the fixing device 60 fixes the toner image onto the medium S by any one mode of the above-described modes. FIG. 7 shows the fixing device 60 at a state that the eccentric cam 66 is moved when the nip pressure is changed from the normal mode to the special mode.

Further, after the medium S having the formed image passes through the outlet HG2 of the fixing device 60, in a case of the normal mode, the controlling part CU stops operation of all components to complete the fixing operation. Alternatively, after the medium S having the formed image passes through the outlet HG2 of the fixing device 60, in a case of the special mode, the controlling part CU changes the posture of the eccentric cam 66 from the special position to the initial position (refer to FIG. 6) by the driving part 68, and then, stops operation of all components to complete the fixing operation.

Next the effect of the embodiment will be described with reference to the drawings.

Figure 14:
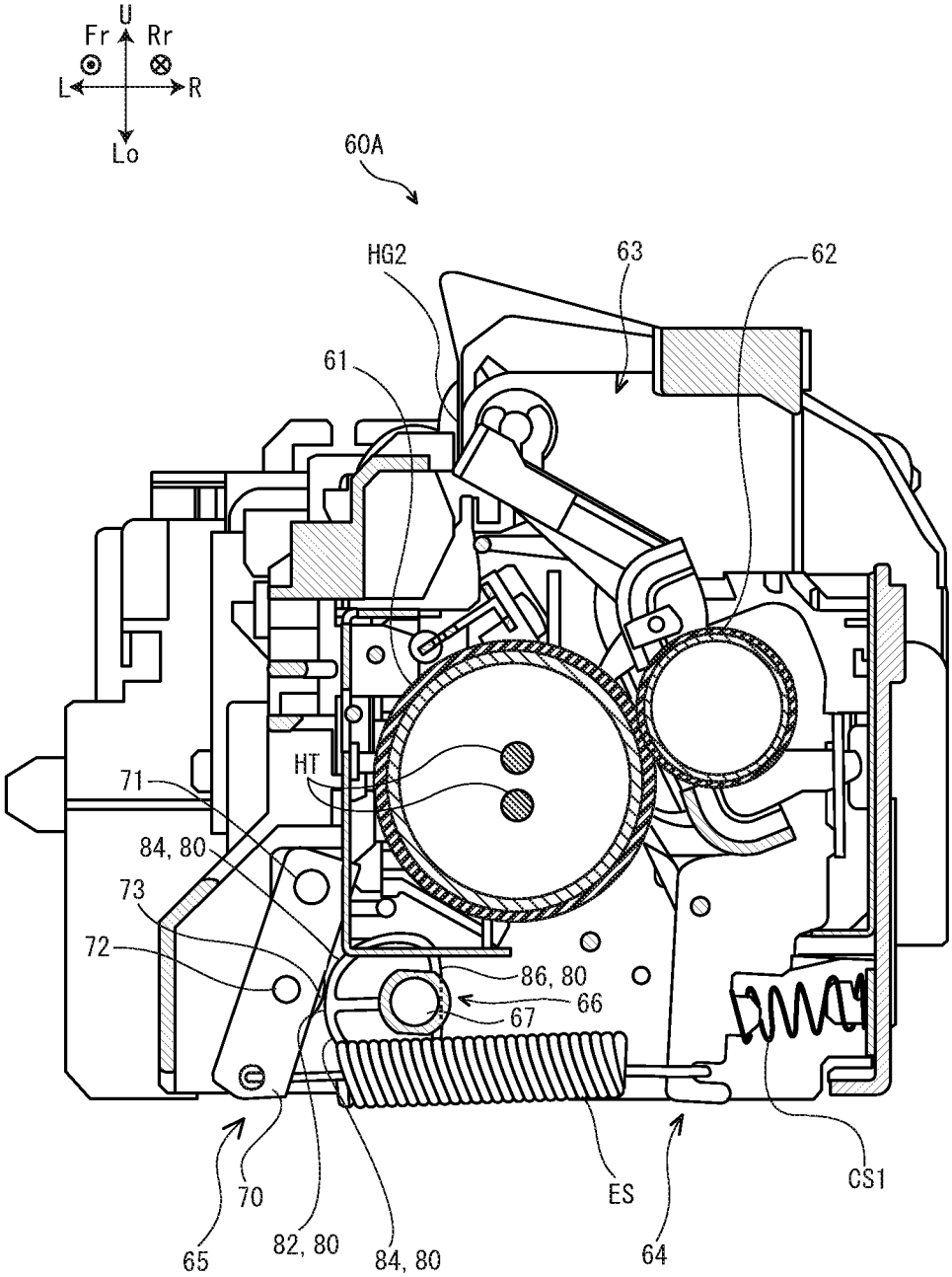
FIG. 14 is a partially sectional view (a sectional view as viewed from a longitudinal direction) showing a fixing device, in a normal mode, according to a comparative embodiment.

For example, in a case of a fixing device 60A of a comparative embodiment shown in FIG. 14, the eccentric cam 66A is fixed by being fitted to the outer circumference of the shaft 67. Moreover, in a case where the fixing operation with respect to the envelope is carried out by using the fixing device 60A of the comparative embodiment, the fixing device 60A makes the roller 73 come into contact with an outer circumference face of the eccentric cam 66A, and simultaneously, rotates the eccentric cam 66A in the positive rotation direction to carry out the changing operation of the nip pressure. In this case, in the fixing device 60A, the eccentric cam 66A is rotated by the driving device 68 to contract the tensile spring ES, but the tensile spring ES is pulled by the first supporting body 64, and accordingly, it is feared that the fixing device 60A overruns by looseness (backlash) in a rotation direction caused in the gear train 92 of the driving part 68. Subsequently, when the fixing device 60A overruns, impulsive sound according to this may occurs.

By contrast, in the fixing device 60 of the present embodiment, as a difference from the fixing device 60A of the comparative embodiment, in a case where the posture of the eccentric cam 66 is changed from the initial position to the special position, the pin 67A slips on the inclined face 104 and the pin 67A presses the end face of the depression 102, and thereby, the eccentric cam 66 is rotated in the positive rotation direction. Moreover, when the eccentric cam 66 is pressed by the coil spring CS2, the pin 67A presses the end face of the depression 102 and comes into contact with the inclined face 104 at the upstream side in the positive rotation direction. Accordingly, in a case of the present embodiment, even if the eccentric cam 66 tries to overrun, on other words, the eccentric cam 66 tries to separate from the pin 67A and to move in the positive rotation direction, it hardly separates from the pin 67A because the pin 67A receives reaction force from the inclined face 104.

Therefore, in the fixing device 60 of the present embodiment, in comparison with the comparative embodiment, the eccentric cam 66 is hard to overrun (overrunning of the eccentric cam 66 is restrained). That is, when the eccentric cam 66 is rotated by the driving part 68 and the tensile spring ES is contracted, it is possible to restrain the eccentric cam 66. Therefore, in the fixing device 60 (and the image forming apparatus 10) of the present embodiment, impulsive sound according to overrunning of the eccentric cam 66 is hard to occur (or even if impulsive sound occurs, its sound pressure may be reduced).

Figure 15:
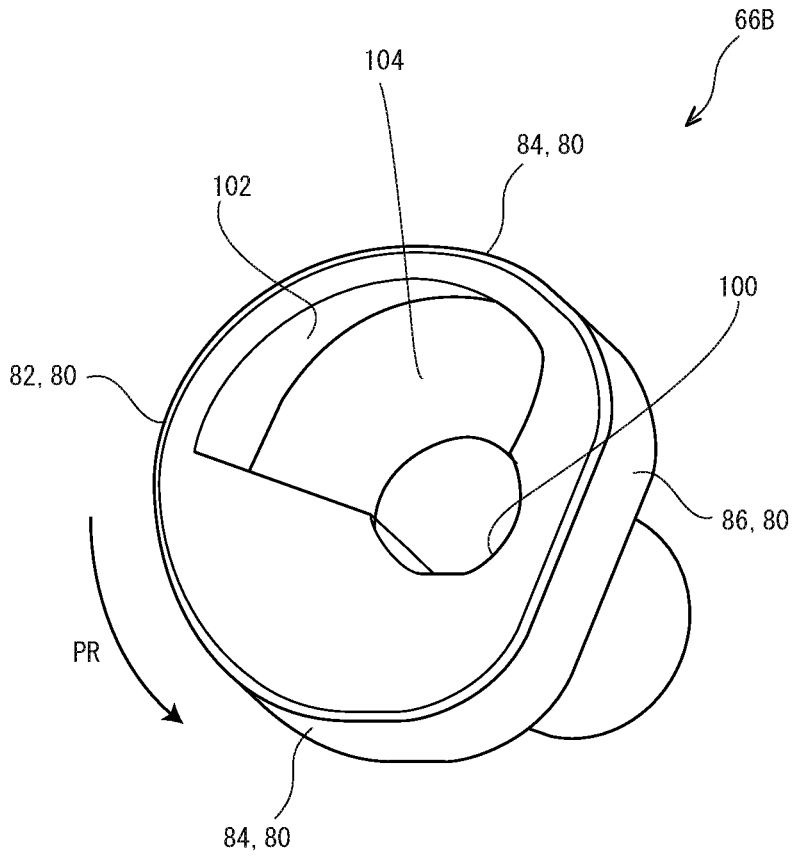
FIG. 15 is a perspective view showing an eccentric cam composing a fixing device according to a modified example.

In addition, in the fixing device 60 of the present embodiment, in the end at the downstream side in the positive rotation direction in the inclined face 104, the through hole 106 is formed so that the part of the pin 67A (refer to FIGS. 10 and 12B) is extended to the outside of the depressions 102 (the outside in the axis direction). Therefore, in a case where the pin 67A meets the end face of the depression 102 according to the positive rotation of the shaft 67, the part of the pin 67A is extended from the through hole 106 to the outside of the depression 102 to meet the coil spring CS2. As a result, in a case of the present embodiment, in comparison with a case where the through hole 106 is not formed (an eccentric cam 66B as a modified example in FIG. 15), impulsive sound when the pin 67A meets the end face of the depression 102 is reduced. That is, impact of the pin 67A is absorbed by the coil spring CS2. Therefore, in the fixing device 60 (and the image forming apparatus 10) of the present embodiment, in comparison with a case where the through hole 106 is not formed in the eccentric cam 66, sound pressure of impulsive sound caused when the pin 67A meets the end face of the depression 102 is reduced. Incidentally, the fixing device including the eccentric cam 66B in FIG. 15 as the comparative embodiment and the image forming apparatus including this fixing device is depend on technical scope of the present disclosure because of having structure achieving the above-described effect.

Although, as described above, the present disclosure was described by citing the present embodiment as an example, the present disclosure is not restricted by the present embodiment. For example, in the technical scope of the present disclosure, the following embodiment is included.

For example, the fixing device 60 of the present embodiment was described so that the heating roller 61 is supported to the lateral plate 63 and the pressuring roller 62 is supported to the first supporting body 64. However, those supporting the rollers may be reversed. That is, the lateral plate 63 may support any one of the heating roller 61 and the pressuring roller 62 as being rotatable and the first supporting body 64 may support another of the heating roller 61 and the pressuring roller 62 as being rotatable.

Moreover, the fixing device 60 of the present embodiment was described so that one example of the heating body is the heating roller 61. However, one example of the heating body may be an endless belt.

The configuration of the present disclosure may be applied to any one of various image forming apparatuses, such as a printer, a copying machine, a facsimile or a multifunction peripheral, and to the fixing device 60 provided in it.

Incidentally, the above-description of the embodiments was described about one example of the fixing device and the image forming apparatus including this according to the present disclosure. However, the technical scope of the present disclosure is not limited to the embodiments. Components in the embodiment described above can be appropriately exchanged with existing components, and various variations including combinations with other existing components are possible. The description of the embodiment described above does not limit the content of the disclosure described in the claims.

The invention claimed is:

1. A fixing device comprising:

a heating body being rotated and heating a medium on which a toner image is formed;

a pressuring body forming a nip with the heating body, being rotated and pressuring the medium passing through the nip;

a lateral plate supporting one body of the heating body and the pressuring body rotatably;

a first supporting body swingably supported to the lateral plate and supporting other body being against the one body rotatably;

a second supporting body swingably supported to the lateral plate and including a rotatable roller;

a tensile spring connected between the first supporting body and the second supporting body at its both ends to pull the first supporting body to a side of the second supporting body;

an eccentric cam rotatably supported at a position between the first supporting body and the second supporting body in the lateral plate, in which a through hole and a depression having an inclined bottom face along a circumference direction are formed, coming into contact with the roller and being rotated in a positive rotation direction to change a posture of the second supporting body and to extend and contract the tensile spring, and thereby, changing a nip pressure of the nip from a first pressure to a second pressure lower than the first pressure;

a rotating shaft going through the through hole;

a protrusion being fixed to the rotating shaft, being in a protrusion direction of a diameter direction of the rotating shaft and coming into contact with the bottom face;

a driving part including a gear train connected to the rotating shaft to transmit torque rotating the eccentric cam to the rotating shaft and a driving source driving the gear train; and a pressing member being fitted to the rotating shaft and pressing the eccentric cam from an opposite side to the protrusion across the bottom face, wherein the bottom face is inclined so as to gradually deepen from an upstream side to a downstream side in the positive rotation direction of the eccentric cam.

2. The fixing device according to claim 1, wherein in an end at the downstream side in the positive rotation direction in the bottom face, a hole is formed so that a part of the protrusion is extended to an outside of the depression, when the rotating shaft is rotated in the positive rotation direction and the eccentric cam changes the nip pressure to the second pressure, the part of the protrusion is extended from the hole to meet the pressing member.

3. The fixing device according to claim 1, wherein the driving part rotates the eccentric cam so as to make the first pressure of the nip pressure in a normal mode in a case where the medium is a plain paper, and rotates the eccentric cam so as to make the second pressure of the nip pressure in a special mode in a case where the medium is not the plain paper.

4. The fixing device according to claim 1, wherein the eccentric cam is formed at an end side in an axis direction of the rotating shaft;

the depression is formed at a center side in the axis direction of the rotating shaft;

the protrusion meets the bottom face from the center side in the axis direction of the rotating shaft.

5. The fixing device according to claim 1, wherein the pressing member is configured as a coil spring clamped between the lateral plate and the eccentric cam at the end side in an axis direction of the rotating shaft.

6. An image forming apparatus comprising:

a forming part forming a toner image onto a medium; and the fixing device according to claim 1 to fix the toner image formed on the medium by the forming part to the medium.

7. An image forming apparatus comprising:

a forming part forming a toner image onto a medium; and the fixing device according to claim 2 to fix the toner image formed on the medium by the forming part to the medium.

8. An image forming apparatus comprising:

a forming part forming a toner image onto a medium; and the fixing device according to claim 3 to fix the toner image formed on the medium by the forming part to the medium.

9. An image forming apparatus comprising:

a forming part forming a toner image onto a medium; and the fixing device according to claim 4 to fix the toner image formed on the medium by the forming part to the medium.

10. An image forming apparatus comprising:

a forming part forming a toner image onto a medium; and the fixing device according to claim 5 to fix the toner image formed on the medium by the forming part to the medium.

* * * * *